United States Patent [19]

Davis

[11] 4,296,610

[45] Oct. 27, 1981

[54] LIQUID CRYOGEN DELIVERY SYSTEM

[75] Inventor: Robert B. Davis, Nyack, N.Y.

[73] Assignee: Union Carbide Corporation, New York, N.Y.

[21] Appl. No.: 140,988

[22] Filed: Apr. 17, 1980

[51] Int. Cl.[3] ..... F17C 7/02

[52] U.S. Cl. ..... 62/55

[58] Field of Search ..... 62/49, 55; 73/295; 137/210

[56] References Cited

U.S. PATENT DOCUMENTS

| | | | |
|---|---|---|---|
| 2,257,897 | 10/1941 | Zenner et al. | 62/1 |
| 2,346,253 | 4/1944 | De Motte | 62/1 |
| 2,632,302 | 3/1953 | Steele | 62/55 |
| 2,798,365 | 7/1957 | Hesson | 62/1 |
| 3,302,416 | 2/1967 | Procter et al. | 62/55 |
| 3,302,417 | 2/1967 | Cowans | 62/55 |
| 3,302,418 | 2/1967 | Walter | 62/55 |
| 3,455,117 | 7/1969 | Prelowski | 62/55 |
| 3,696,627 | 10/1972 | Longsworth | 62/51 |
| 3,802,213 | 4/1974 | Ooka | 62/55 |
| 4,010,623 | 3/1977 | Kaschak | 62/55 |
| 4,010,779 | 3/1977 | Pollock et al. | 141/44 |

*Primary Examiner*—Ronald C. Capossela

*Attorney, Agent, or Firm*—Stanley Ktorides; Adda C. Gogoris

[57] ABSTRACT

Apparatus and process for delivering small controlled quantities of a liquid cryogen to a use point in an intermittent manner comprising an off-period in which no liquid is desired at the use point and followed by an on-period in which liquid is delivered to the use point essentially free of vapor.

7 Claims, 4 Drawing Figures

FIG. 1
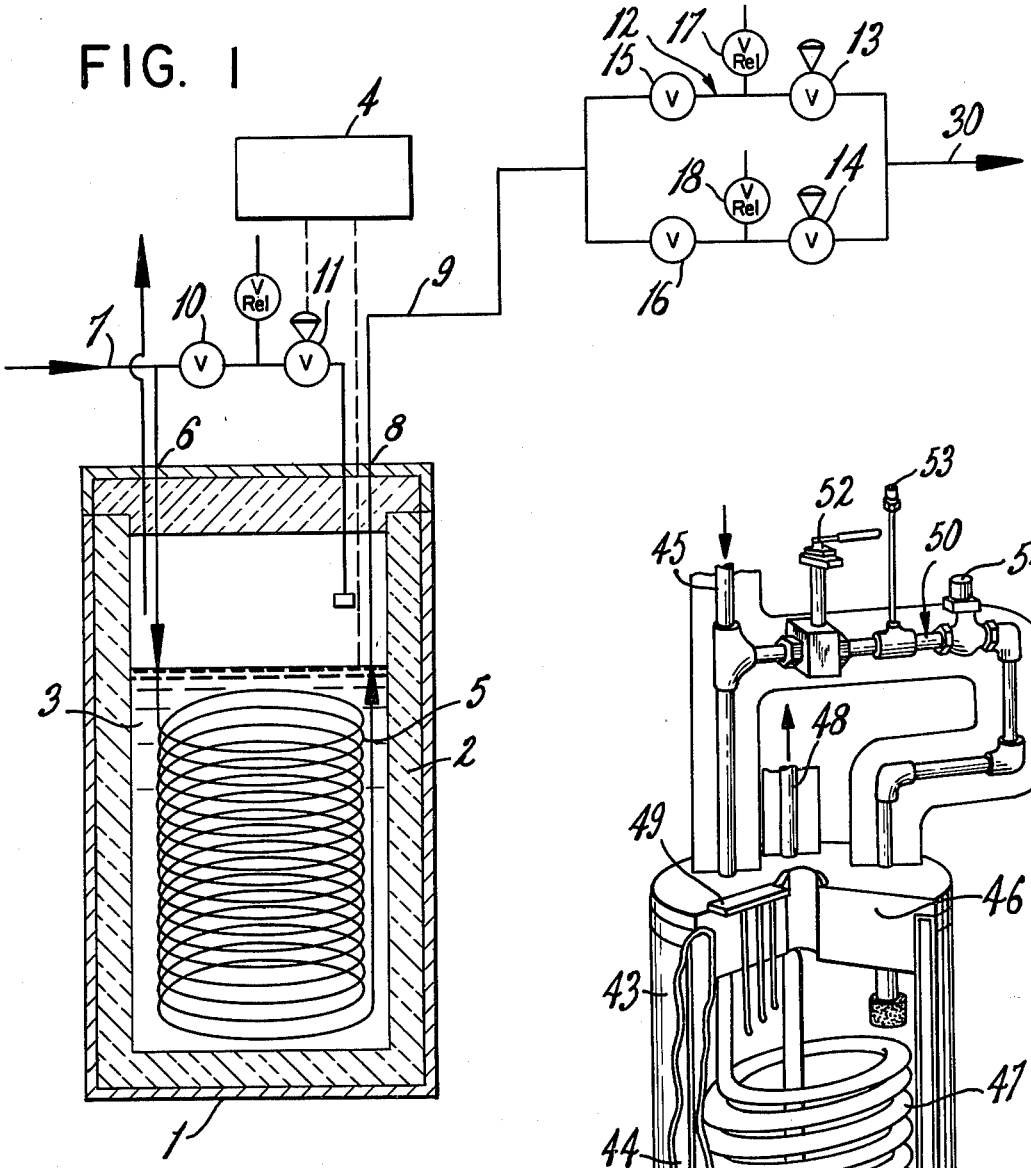
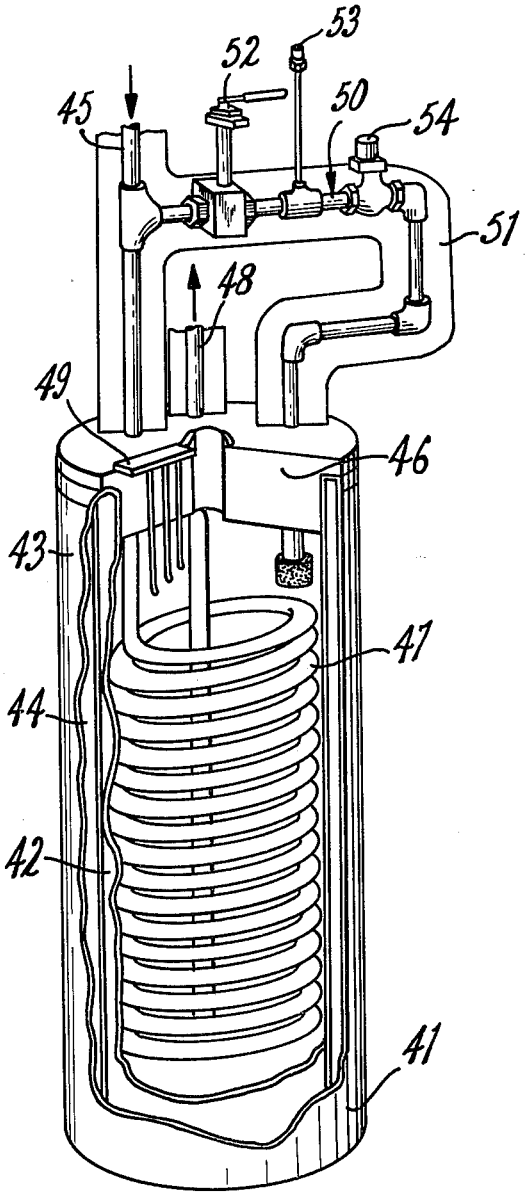
FIG. 4

LIQUID CRYOGEN DELIVERY SYSTEM

BACKGROUND OF THE INVENTION

This invention relates to a process and apparatus for delivering a liquid cryogen to a use point. More particularly, the invention relates to a process and apparatus for delivering small quantities of a liquid cryogen, such as liquid nitrogen, liquid oxygen, liquid argon, etc., intermittently to a use point in a controlled manner.

Many applications, such as cooling of dies in aluminum die extrusion, purging of cans in the canning industry, etc., require supplying relatively small (up to about 400 lbs/hr) controlled amounts of a cryogenic liquid, e.g. liquid nitrogen, to a use point. In such applications, control of the amount of liquid dispensed, control of the amount of refrigeration provided, and control of the timing of dispensation are very important. In transferring the liquid cryogen from a (remote) supply source to the use point, the conventional practice of transferring liquid through an insulated conduit is often unacceptable because of heat leaks which cause a relatively large fraction of the liquid mass transferred to vaporize, especially in applications such as aluminum die extrusion which involve high temperatures at or near the use point. For example, in a typical aluminum die extrusion plant, a $\frac{3}{4}$ in. nominal diameter liquid nitrogen pipe, insulated with 3 in. of urethane foam, will vaporize, because of heat leak alone, about 13.9 lbs/hr of liquid nitrogen for every 150 ft. of a pipe length, i.e. an amount at least within the same order of magnitude as the amount of the desired liquid nitrogen flow used in cooling the aluminum extrusion die, and often many times that amount. This causes problems with cryogen flow control and interferes with control of the amount of liquid cryogen delivered to the use point, resulting in loss of refrigeration at the use point and/or waste of liquid cryogen.

In addition, if the flow of liquid cryogen is intermittent, the problem is compounded further because the residual liquid in the pipe continues to vaporize during non-use periods, necessitating purging the pipe of vapor before any liquid can be delivered to the use point, thus slowing down the process and often resulting in further waste of cryogen.

Furthermore, heat leak is not the only factor causing vaporization. An additional, though usually smaller, amount of cryogen vaporizes by flash vaporization due to pipe line pressure drop. This flash vaporization factor may become very significant, especially when cryogen is transferred from a remote supply source and undergoes a change in elevation.

It is desirable, therefore, to have a liquid cryogen delivery system which is capable of delivering small predetermined quantities of a liquid cryogen (i.e. essentially free of vapor) promptly to a use point in a controlled manner and on an intermittent basis, and with minimum loss of refrigeration.

One technique used in the prior art for transporting liquid cryogen has involved a concentric pipe system having a coolant in the outer jacket. Concentric pipe construction, however, is expensive, complicated, not suited to intermittent flow, and inefficient because vaporization of the jacket liquid results in coolant waste. Use has also been made of phase separators designed to separate and vent vaporized cryogen. Such separators, however, deliver liquid in a saturated liquid state (at line pressure) and fail to prevent further vaporization downstream.

OBJECTS OF THE INVENTION

It is therefore an object of this invention to provide a method and apparatus for delivering a controlled intermittent low flow of liquid cryogen (essentially free of vapor) to a use point.

It is a further object of this invention to provide a method and apparatus for such liquid cryogen delivery which will not only condense vaporized cryogen, but which will prevent further vaporization of such cryogen downstream of the condensation point until the use point is reached.

It is another object of this invention to provide immediate delivery of liquid cryogen at the use point on an intermittent basis with minimum loss of refrigeration and minimum cryogen waste and to control the flow of such cryogen.

These and other objects of the present invention will be apparent to one skilled in the art, in light of the following description.

SUMMARY OF THE INVENTION

One aspect of the present invention comprises an apparatus capable of delivering small controlled quantities of a liquid cryogen to a use point in an intermittent manner comprising an on-period during which a predetermined amount of liquid cryogen is delivered to said use point continuously during said on-period, followed by an off-period during which no liquid cryogen is desired at said use point, said apparatus comprising in combination:

(a) insulated conduit means for transferring cryogen from a liquid cryogen supply source to said use point;

(b) subcooling means adjacent said use point and upstream thereof, adapted to condense vaporized cryogen in said conduit means and to subcool said cryogen; and (c) flow control means located downstream of said subcooling means, adapted to cause a low flow of cryogen downstream of said subcooling means during said off-period, said low flow being sufficient upon vaporization to offset heat leaks in, as well as purge cryogen vapor from, said conduit means downstream of said subcooler, said flow control means also being adapted to cause a high flow of said cryogen during said on-period so that said predetermined amount of liquid cryogen is delivered to said use point essentially free of vapor.

Another aspect of the invention comprises a process for delivering small controlled quantities of liquid cryogen to a use point in an intermittent manner comprising an on-period during which a predetermined amount of said liquid cryogen is delivered to said use point continuously for the duration of said on-period followed by an off-period during which no liquid cryogen is desired at said use point, said method comprising:

(a) transferring said cryogen through a conduit from a liquid cryogen supply source to said use point;

(b) in the course of said transfer and adjacent said use point, cooling said cryogen so as to condense all vapor formed therein and to further subcool said liquid to a temperature at which the equilibrium vapor pressure is less than the pressure of said liquid; and (c) controlling the flow of said cryogen in said conduit downstream of the point at which said subcooling takes place by (i) adjusting said flow to a low value during said off-period sufficient to completely absorb the heat added through heat leak downstream of said cooling point, thereby vaporizing said cryogen so that essentially no liquid cryogen reaches said use point, and (ii) adjusting said flow to a higher value during said on-period so that said predetermined amount of said cryogen is delivered to said use point essentially free of vapor.

As used herein, the term "use cryogen" shall mean the cryogen which is intended for delivery in a liquid condition to the use point, as distinguished from the "subcooler cryogen" which may be the same substance as the use cryogen, but which is intended for use as a coolant in the subcooler for subcooling the use cryogen.

As used herein, the term "upstream" shall apply to equipment and conditions from the liquid cryogen supply source to the subcooler or cooling point, and the term "downstream" shall apply to equipment and/or conditions from said subcooler or cooling point to the liquid cryogen use point.

As used herein, the term "cryogen subcooler" or "subcooler" shall mean vapor condensing means delivering liquid cryogen at its outlet end in a subcooled liquid state, i.e. at a pressure higher than its equilibrium vapor pressure at the temperature at which said cryogen exits from said subcooler.

As used herein, the term "intermittent delivery cycle" or "intermittent use cycle" shall mean a repetitive cycle comprising a period of continuous delivery of a predetermined quantity of liquid cryogen to the use point (hereinafter referred to as the "on-period") followed by a period during which no liquid cryogen is delivered to said use point (hereinafter referred to as the "off-period").

BRIEF DESCRIPTION OF THE DRAWINGS

FIG. 1 is a schematic drawing of an exemplary embodiment of the apparatus of the present invention, as well as an illustration of the process.

FIG. 4 illustrates in lengthwise cross-section a preferred embodiment of a subcooler used in the practice of this invention.

DETAILED DESCRIPTION OF THE INVENTION

Figure 2:
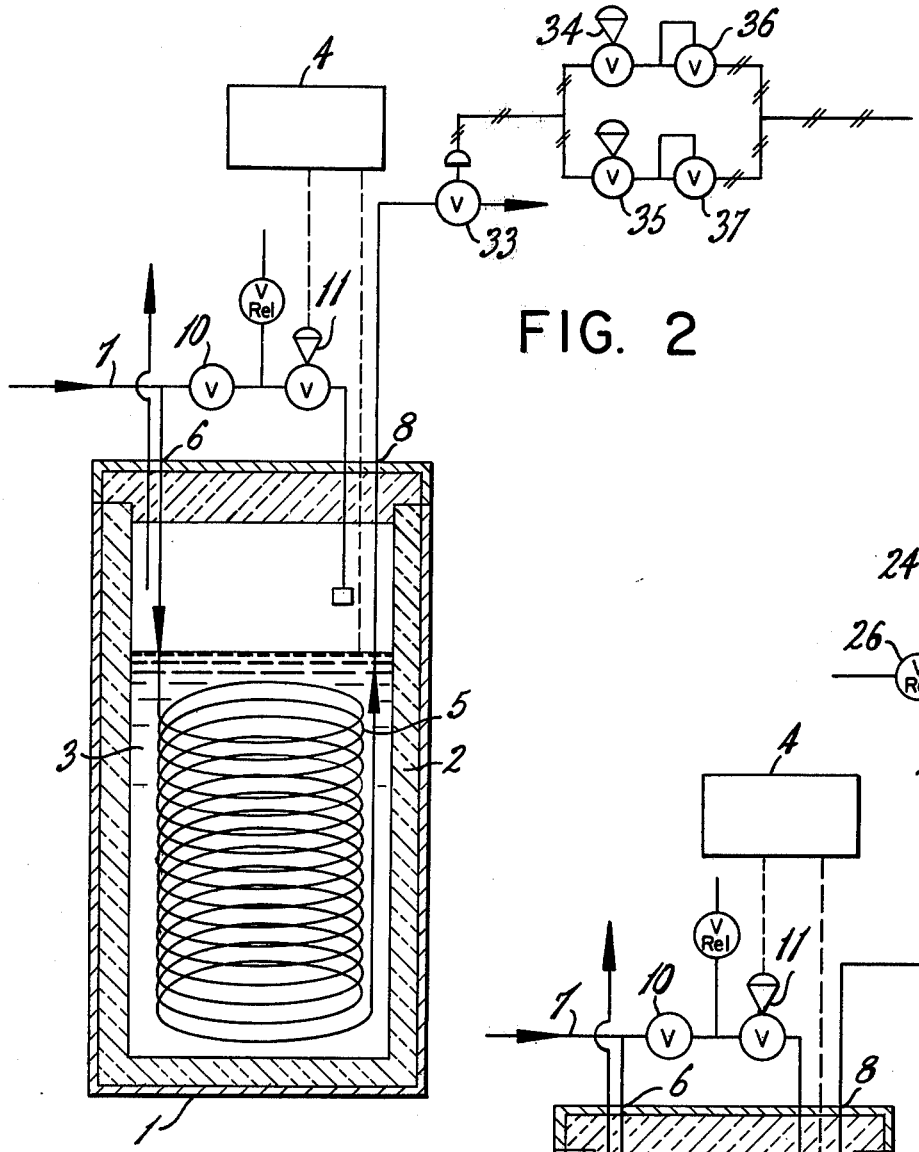
FIG. 2 is the same as FIG. 1, except for disclosing an alternative valve manifold arrangement.

The present invention employs a subcooler located adjacent (i.e. as close as possible to) the use point, capable of (a) condensing any liquid cryogen vapor formed upstream of said subcooler because of heat leaks in upstream conduits and/or flash vaporization due to upstream conduit line pressure drop, and (b) subcooling the cryogen sufficiently so as to (i) offset downstream heat leaks by vaporizing a small amount of cryogen during off-periods and (ii) prevent vapor formation downstream during on-periods until the cryogen reaches the use point. The purpose of locating the subcooler as close to the use point as possible is to minimize pressure drop (and flash vaporization incident thereto) and prevent unnecessarily long exposure of the liquid cryogen to heat leaks, downstream of said subcooler.

During off-periods, in an intermittent use cycle, the liquid cryogen flow is not completely shut-off. A small flow is maintained such that essentially all of the flowing liquid is just vaporized by the time it exits the downstream piping, i.e. so that the heat leak of the downstream piping equals the energy absorbed by the small flow during conversion from subcooled liquid to saturated vapor. As mentioned before, the subcooler is located adjacent to the use point so that there is essentially no flash vaporization due to pressure drop downstream from the subcooler. During on-periods the valve means is opened to a higher flow so that the requisite amount of liquid cryogen is delivered to the use point essentially free of vapor.

The process and apparatus of the present invention will be further described with particular reference to FIG. 1, consisting of a schematic representation of the apparatus and providing an illustration of the process in a preferred embodiment of the present invention.

Shown on FIG. 1 is subcooler 1 comprising an insulated vessel 2 filled with subcooler liquid cryogen 3 (at essentially ambient pressure) and equipped with liquid level controller 4. Immersed in liquid cryogen 3 is heat exchanger 5, (which may consist of a hollow copper coil) which, at its vessel 2 inlet end 6, is coupled to upstream insulated piping 7 which transfers use cryogen from a liquid cryogen supply source (not shown) to heat exchanger 5, and which, at its vessel 2 outlet end 8, is coupled to downstream insulated pipe 9, used for carrying out liquid cryogen (after subcooling) to the use point 30.

Liquid level controller 4 is used to maintain the subcooler cryogen liquid level in vessel 2 by diverting a portion of the liquid cryogen from supply line 7 (or from a separate source, if desired) through valve 10 and solenoid valve 11 to vessel 2.

Flow control at use point 30 is accomplished through valve manifold 12 comprising high flow solenoid valve 13 and low flow solenoid valve 14 piped in parallel. During an intermittent cycle, valve 14 is open during off-periods letting just sufficient cryogen through, as adjusted using manual trim valve 16, to cool and purge pipe 9. Valve 14 is closed and valve 13 is opened when liquid cryogen flow is required at use point 30, the amount of said flow being adjusted by manual trim valve 15. In addition, valve manifold 12 comprises relief valves 17 and 18.

Figure 3:
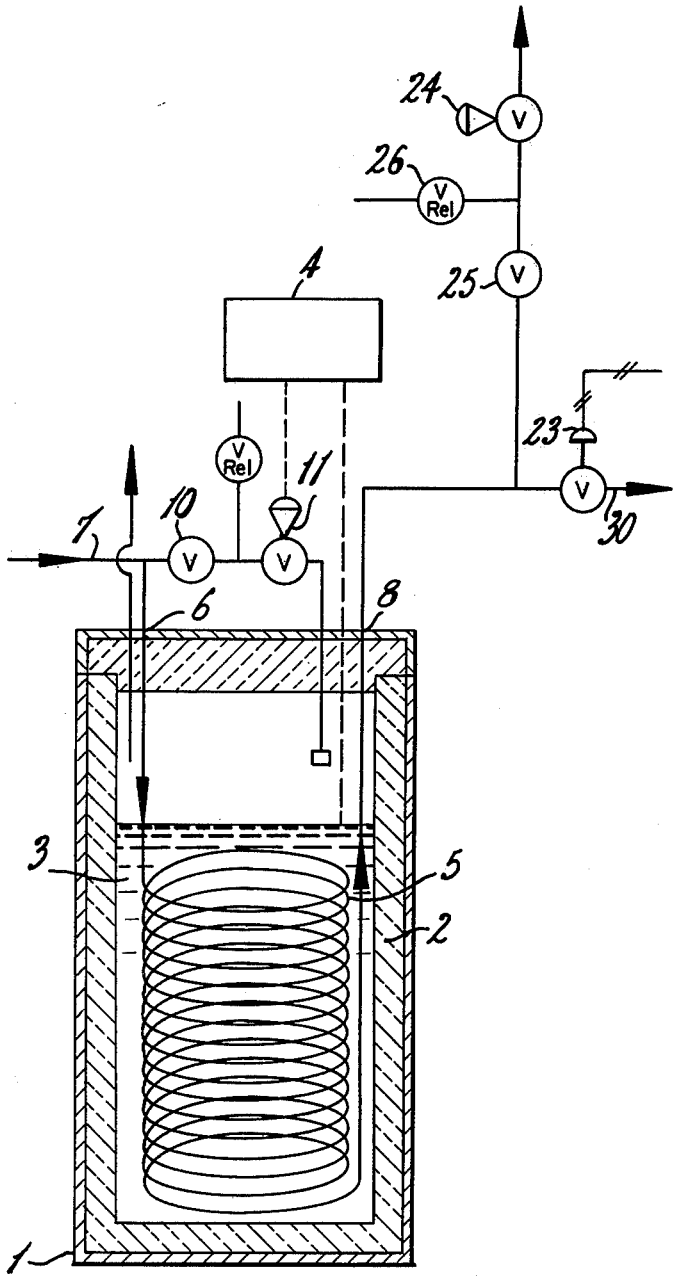
FIG. 3 is likewise the same as FIG. 1, except for a still different valve manifold arrangement involving use of a pneumatic valve control system.

FIGS. 2 and 3 are identical to FIG. 1 except for their respective valve manifolds. FIG. 2 shows an alternative valve arrangement where use cryogen flow is controlled by pneumatically activated valve 23 which is set to an off-position during off-periods (low-flow) and to an on-position during on-periods (high flow). Low flow is handled by solenoid valve 24 which is then opened, said low flow being regulated by manual trim valve 25. Valve 26 is a relief valve.

FIG. 3 shows an alternative valve arrangement also using a pneumatically activated valve, labeled 33 in the FIG., which is controlled by a valve arrangement using instrument air and involving high flow signal solenoid 34 in series with high flow regulator 36, open during high flow (on-periods) and low flow signal solenoid 35 and low flow regulator 37, open during low flow (off-period).

It is to be understood that valve arrangements in FIGS. 1, 2 and 3 are merely illustrative and by no means exhaustive of the possible methods and apparatus for flow control which may be used in practicing the present invention. Different arrangements may be preferred in different applications, such preference being within the scope of the art.

FIG. 4 is a detailed drawing of a preferred embodiment for a subcooler employed in the practice of this invention. Other types of subcoolers may also be used. In FIG. 4, subcooler 41 comprises stainless steel vessel 42 mounted on stainless steel casing 43 with an insulating and high vacuum layer 44 in-between. Inlet use cryogen pipe 45 penetrates insulating vessel cover 46 and is coupled to the inlet end of heat exchanger coils 47. Outlet use cryogen pipe 48 is coupled to the outlet end of heat exchanger 47. Liquid level probes 49 are connected to a liquid level controller (not shown) which is coupled with valve manifold 50 controlling subcooler liquid cryogen supply pipe 51. Valve manifold 50 comprises a flow control regulator 52, a pressure relief valve 53 and a liquid control level solenoid valve 54. Both use cryogen pipes 45 and 48, and subcooler nitrogen pipe 51, are insulated. Insulating cover 46 also comprises a vapor cryogen vent.

In operation, the invention is described as follows, again with particular reference to FIG. 1. Use cryogen is transferred from its supply source, through upstream insulated pipe 7 and inlet end 6 into heat exchanger 5, where said use cryogen is completely condensed and subcooled so as to be at a higher pressure than its equilibrium vapor pressure at said use cryogen temperature upon exit from heat exchanger outlet 8 and entry into downstream insulated pipe 9. The degree of subcooling must be coordinated with the off-period low flow of the cryogen, through valve 14, so that the enthalpy change in the cryogen from the subcooled liquid to the saturated liquid state plus the heat of vaporization of said cryogen will be in balance with the heat leak of downstream pipe 9. As mentioned before, the length of downstream pipe 9 is minimized by placing the subcooler adjacent the use point, so as to minimize downstream heat leak and so as to essentially eliminate downstream line pressure drop. The result of this is that during an off-period of the intermittent liquid cryogen flow, there is just sufficient cryogen flow in pipe 9 to keep the pipe cold and to purge it of vapor so that during a subsequent on-period of the intermittent cycle the precise desired liquid flow of use cryogen can be instantly delivered essentially free of vapor, upon opening of high flow valve 13.

Subcooler liquid cryogen 3 is maintained at a specified level at ambient pressure in vessel 2 through liquid level controller 4 by diverting cryogen through valves 10 and 11 into vessel 2 as necessary.

The invention can be further illustrated by the example which follows.

EXAMPLE 1

The desired flow of liquid nitrogen at the use point is 150 lbs/hr available at 10 psig for 30 seconds out of a 60 second cycle. The amount of liquid vaporized in the supply line (due to heat leak and pressure drop) is 20 lbs/hr. This is equivalent to a gas volume of 70 cubic feet/hour (at line conditions), while the volume of 150 lbs/hr of liquid is only 3 cubic feet/hour. Thus, the "typical" system employing an off/on valve would be gas bound during the on-period and unable to supply the desired refrigeration. By use of the present invention the 20 lbs/hr of vapor generated is condensed in the subcooler which is located as close as possible to the use point. The liquid is then subcooled further to a saturation pressure of about 2 psig. During the off-period of the cycle a low flow is established to: (1) purge the vapor out of the downstream line and (2) to maintain a cold line. This flow is such that the heat leak into the line is offset by the subcooling and heat of vaporization of the liquid nitrogen at low flow; flash due to pressure drop at the low flow is negligible. The heat leak may be calculated by the following equation:

$$Q=(M)\times(\Delta H)$$

where:

Q = heat leak into the line downstream of the subcooler

M = nitrogen flow

ΔH = subcooling sensible heat and the heat of vaporization of the liquid nitrogen.

The flow is set manually by observing when most of the exiting low flow is vapor and very little liquid, but automatic control can be used.

The high flow subcooled liquid can absorb some additional heat before vaporizing. For example, 10 psig liquid nitrogen subcooled to a saturation pressure of 2 psig can absorb about 3 BTU/lb before any vapor forms. Thus, at a flow rate of 150 lbs/hr, 450 BTU/hr could be absorbed before vapor formation. This is equivalent to eliminating the vaporization of about 5 lbs/hr of liquid which would generate a gas volume of 17.5 cubic feet/hr (at about −320° F. and line pressure), again almost six times the volume of the desired liquid flow.

What is claimed is:

1. Apparatus capable of delivering small controlled quantities of a liquid cryogen to a use point in an intermittent manner comprising an on-period during which a predetermined amount of liquid cryogen is delivered to said use point continuously during said on-period, followed by an off-period during which no liquid cryogen is desired at said use point, said apparatus comprising in combination:

(a) insulated conduit means for transferring cryogen from a liquid cryogen supply source to said use point;

(b) subcooling means adjacent said use point and upstream thereof, adapted to condense vaporized cryogen in said conduit means and to subcool said cryogen; and (c) flow control means located downstream of said subcooling means, adapted to cause a low flow of cryogen downstream of said subcooling means during said off-period, said low flow being sufficient upon vaporization to offset heat leaks in, as well as purge cryogen vapor from, said conduit means downstream of said subcooler, said flow control means also being adapted to cause a high flow of said cryogen during said on-period so that said predetermined amount of liquid cryogen is delivered to said use point essentially free of vapor.

2. The apparatus of claim 1 wherein said subcooling means is adapted to receive a second quantity of liquid cryogen to be employed as a coolant at essentially ambient pressure.

3. The apparatus of claim 2 wherein said flow control means comprises at least one low-flow valve to be employed during off-periods and at least one high flow valve to be used during on-periods connected in parallel with said low flow valve.

4. The apparatus of claim 2 wherein said flow control means comprises a pneumatically activated valve operating at two signal pressures:

(a) a low flow signal pressure during said off-period, and (b) a high flow signal pressure during said on-period.

5. A process for delivering small controlled quantities of liquid cryogen to a use point in an intermittent manner comprising an off-period during which no liquid cryogen is desired at said use point followed by an on-period during which a predetermined amount of said liquid cryogen is delivered to said use point continuously for the duration of said on-period, said method comprising:

(a) transferring said cryogen through a conduit from a liquid cryogen supply source to said use point;

(b) in the course of said transfer and adjacent said use point, cooling said cryogen so as to condense all vapor formed therein and to further subcool said liquid to a temperature at which the vapor pressure of said liquid is higher than its equilibrium vapor pressure at said temperature; and (c) controlling the flow of said cryogen in said conduit downstream of the point at which said subcooling takes place by (i) adjusting said flow to a low value during said off-period sufficient to completely absorb the heat added through heat leak downstream of said cooling point, thereby vaporizing said cryogen so that essentially no liquid cryogen reaches said use point and compensating for said heat leak, and (ii) adjusting said flow to a higher value during said on-period so that said predetermined amount of said cryogen is delivered to said use point essentially free of vapor.

6. The process of claim 5, wherein during said on-period the desired quantity of liquid cryogen at the use point ranges between about 10 and 400 lbs/hr.

7. The process of claim 5 wherein said cryogen is liquid nitrogen.

* * * * *